United States Patent [19]

Janes

[11] Patent Number: 4,741,676

[45] Date of Patent: May 3, 1988

[54] MARINE ENGINE POWER TAKE-OFF FOR A HYDRAULIC PUMP

[76] Inventor: Douglas D. Janes, 19215 7th Ave. W., Lynnwood, Wash. 98036

[21] Appl. No.: 865,500

[22] Filed: May 21, 1986

[51] Int. Cl.[4] ..... F04B 17/00; F04B 35/00

[52] U.S. Cl. ..... 417/362; 417/360; 417/364; 474/94; 123/195 A

[58] Field of Search ..... 417/359, 360, 362, 364; 474/902, 903, 94; 248/674, 672; 123/195 A, 195 P, 195 S

[56] References Cited

U.S. PATENT DOCUMENTS

| | | | |
|---|---|---|---|
| 3,613,645 | 10/1971 | Froumajou | 123/195 A X |
| 3,643,642 | 2/1972 | Junes | 123/195 A X |
| 3,756,751 | 9/1973 | Holmes | 417/364 |
| 3,927,954 | 12/1975 | Walker | 417/364 X |
| 4,175,511 | 11/1979 | Krautkremer | 115/35 |
| 4,300,872 | 11/1981 | Brown et al. | 417/364 X |
| 4,406,633 | 9/1983 | Hamm | 440/75 |

*Primary Examiner*—Carlton R. Croyle

*Assistant Examiner*—Eugene L. Szczecina, Jr.

*Attorney, Agent, or Firm*—Ward Brown; Robert W. Beach

[57] ABSTRACT

A hydraulic pump is mounted on a bracket which, in turn, is mounted on a frame secured to a marine engine. The mounting of the frame on the engine allows for substantially universal swiveling and translation adjustment to position a rearward-projecting stub shaft of the frame stationarily and in coaxial alignment with the forward-projecting front end portion of the engine crankshaft. A cogwheel or pulley is rotatably mounted on the stub shaft and is joined to the engine crankshaft by a flexible coupling. Such cogwheel or pulley drives a belt which powers the driven input wheel or pulley of the pump. The substantial tension of the belt is applied to the stub shaft of the frame without transmission to the engine crankshaft, and the coupling of the pump to the engine is not effected by vibration, twisting or fore-and-aft surging of the engine in response to developed torque and thrust.

3 Claims, 3 Drawing Sheets

MARINE ENGINE POWER TAKE-OFF FOR A HYDRAULIC PUMP

BACKGROUND OF THE INVENTION

1. Field of the Invention

The present invention relates to power take-off mechanism for a primary internal combustion engine of a vehicle. More specifically, the present invention relates to mechanism for coupling a hydraulic pump to the front or nondriving end of a marine engine crankshaft and enabling the pump to be spaced radially from the crankshaft without applying appreciable radial force to the crankshaft.

2. Prior Art

A variety of hydraulically powered add-on accessories have been proposed for large boats and yachts, such as hydraulically powered bow thrusters. Such accessories require a high capacity pump. It is desirable to drive such a pump by the existing internal combustion engine, as compared to providing a separate source of power for driving the pump, but coupling a high capacity pump to an existing engine has presented several problems. If the pump is to be coupled to the rear or driving end portion of the engine crankshaft, there may be no convenient location for mounting the pump and major alterations to the drive shaft and couplings may be required. If the pump is to be coupled to the front or nondriving end portion of the crankshaft, again there may be no conveniently accessible location for the pump. In either event, the crankshaft and its supporting bearings cannot withstand substantial radially directed force such as would result if the high capacity pump is simply mounted in the boat independently of the engine and coupled to the crankshaft by pulleys and a belt. The minimum disadvantage of such an installation would be voiding the manufacturer's warranty for the engine.

It has been proposed to mount the pump in front of an engine with the pump input shaft coaxial with the engine crankshaft. Such a coaxial installation may require more space than is available in front of an existing engine.

Another problem is that the engine vibrates, twists in response to the output torque and even surges fore-and-aft in response to the developed thrust. When a hydraulic pump is mounted separately from the engine, such movement of the engine increases wear and tear on the couplings and bearings.

Hamm U.S. Pat. No. 4,406,633, issued Sept. 27, 1983, discloses a marine engine power take-off for a hydraulic pump in which the pump is mounted on the keel separately from the primary engine and is coupled to the rearward-projecting end portion of the crankshaft.

Krautkremer U.S. Pat. No. 4,175,511, issued Nov. 27, 1979, discloses a tugboat having hydraulically powered thrusters with the hydraulic pump being coupled to the front or nondriving end of an engine crankshaft.

Brown et al. U.S. Pat. No. 4,300,872 discloses a system for mounting a hydraulic pump on an outboard motor with the pump input shaft coaxial with the flywheel.

Holmes U.S. Pat. No. 3,756,751 discloses a hydraulic pump mounted on the clutch housing of a forklift truck and driven by the lift truck engine.

SUMMARY OF THE INVENTION

The principal object of the present invention is to provide mechanism for coupling a hydraulic pump to an engine, particularly a marine engine, at a convenient location, such as below the front end portion of the engine, in a form assuring that no appreciable radially directed force is applied to the engine crankshaft, although there is unrestricted transmission of torque from the crankshaft to the pump input shaft, and minimizing the effects of vibration, twisting and fore-and-aft surging of the engine in response to developed torque and thrust.

In the preferred embodiment of the present invention the foregoing object is accomplished by mounting the hydraulic pump on a bracket which, in turn, is mounted on a frame secured to the engine. The mounting of the frame on the engine allows for substantially universal swiveling and translation adjustment so as to position a rearward-projecting stub shaft of the frame stationarily and in precise coaxial alignment with the forward-projecting front end portion of the engine crankshaft. A cogwheel or pulley is rotatably mounted on the stub shaft and is joined to the engine crankshaft by a flexible coupling. Such cogwheel or pulley drives a belt which powers the driven input wheel or pulley of the pump.

DETAILED DESCRIPTION

Figure 1:
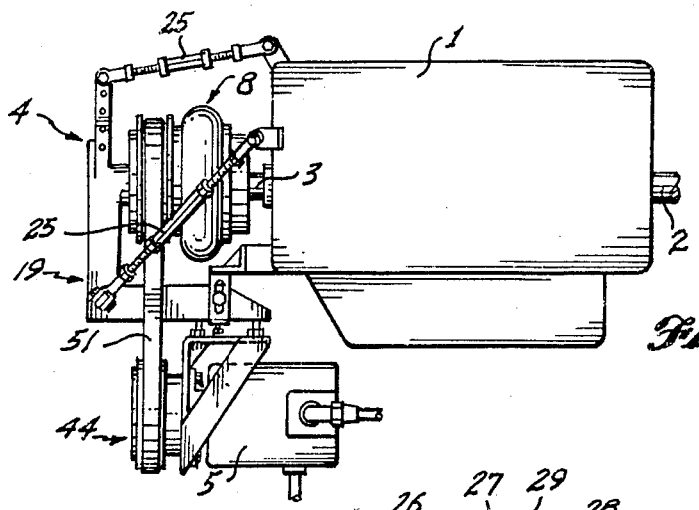
FIG. 1 is a side elevation of a marine engine and a power take-off for a hydraulic pump in accordance with the present invention.

FIG. 1 illustrates diagrammatically a marine engine 1 having a crankshaft including a rearward-projecting portion 2 coupled to the drive shaft (not shown) of the boat in which the engine is mounted. The crankshaft has a forward-projecting portion 3 which is coupled to power take-off mechanism 4 in accordance with the present invention to power a high capacity hydraulic pump 5 for accessories such as bow thrusters. In a representative installation, the engine could be a 295 to 450 horsepower marine diesel engine available from Cummins Engine Company, Inc., of Columbus, Ind., for driving a variable displacement pump providing maximum pressure of 3000 pounds per square inch. The pump could be used to power the model T-25 bow thrusters available from Western Marine Electronics (WESMAR) of Bothell, Wash.

Figure 2:
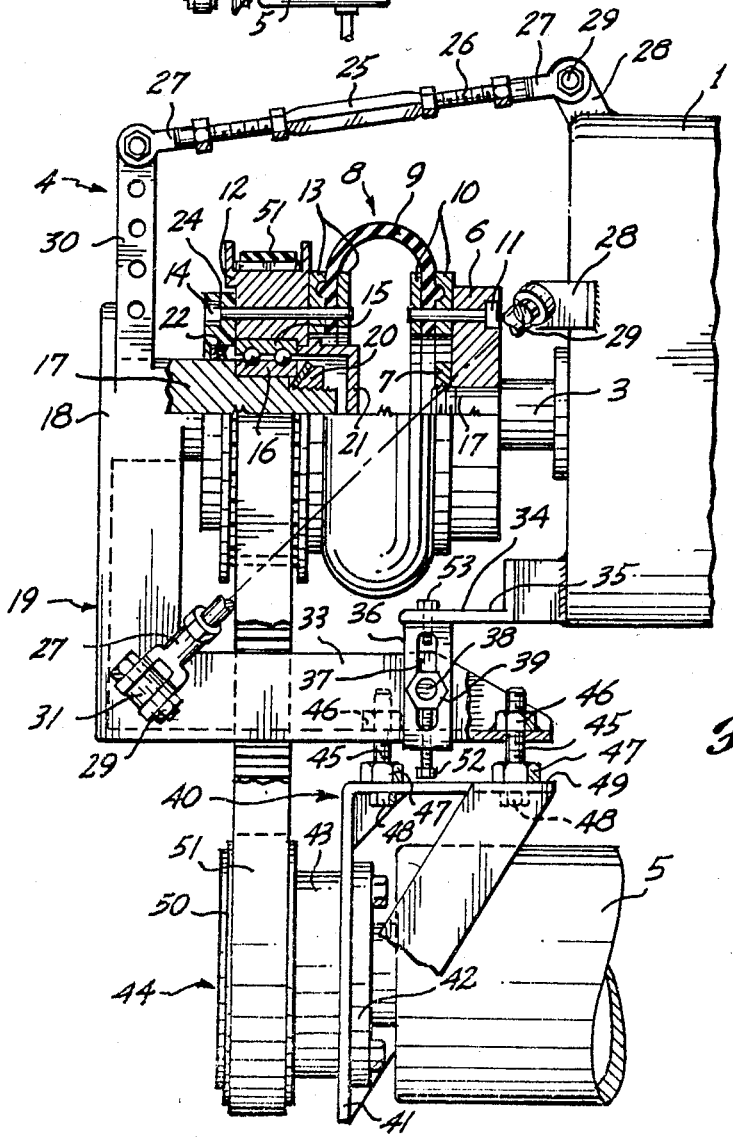
FIG. 2 is an enlarged side elevation of, primarily, the power take-off of FIG. 1 with parts broken away.

With reference to FIG. 2, usually the crankshaft portion 3 carries a pulley at its forward end. For the purposes of the present invention, such pulley is replaced by a mounting disk 6 which can be secured to the crankshaft by a nut 7. Disk 6 is secured to one side of a conventional flex coupling 8. The force-transmitting component of the coupling is a flexible sleeve or toroid 9 having its rear end portion secured to the mounting disk 6 by clamping rings 10 and bolts 11. The forward end of the flexible sleeve or toroid 9 is secured to a sheave 12, preferably a cogwheel, by clamping rings 13 and bolts 14. In a representative installation the flex coupling could be a "spacer coupling" of the type sold under the trademark Para-Flex by Dodge Reliance Electric of Greenville, S.C.

Sheave 12 has a central aperture receiving the outer ring 15 of a double race ball bearing in press fit relationship. The inner ring 16 of the bearing is held on the rabbeted rear end portion of a stub shaft 17 by a retaining nut 20. A press fit dust cover or cap 21 is provided at the rear or inner side of the bearing, inside the flex coupling 8, and an annular seal 22 is provided at the forward or outer side of the bearing engaged between the stub shaft 17 and a retainer ring 24. Ring 24 is secured to the sheave 12 by the same bolts 14 which pass through the sheave and tighten the clamping rings 13 of the flex coupling.

Figure 3:
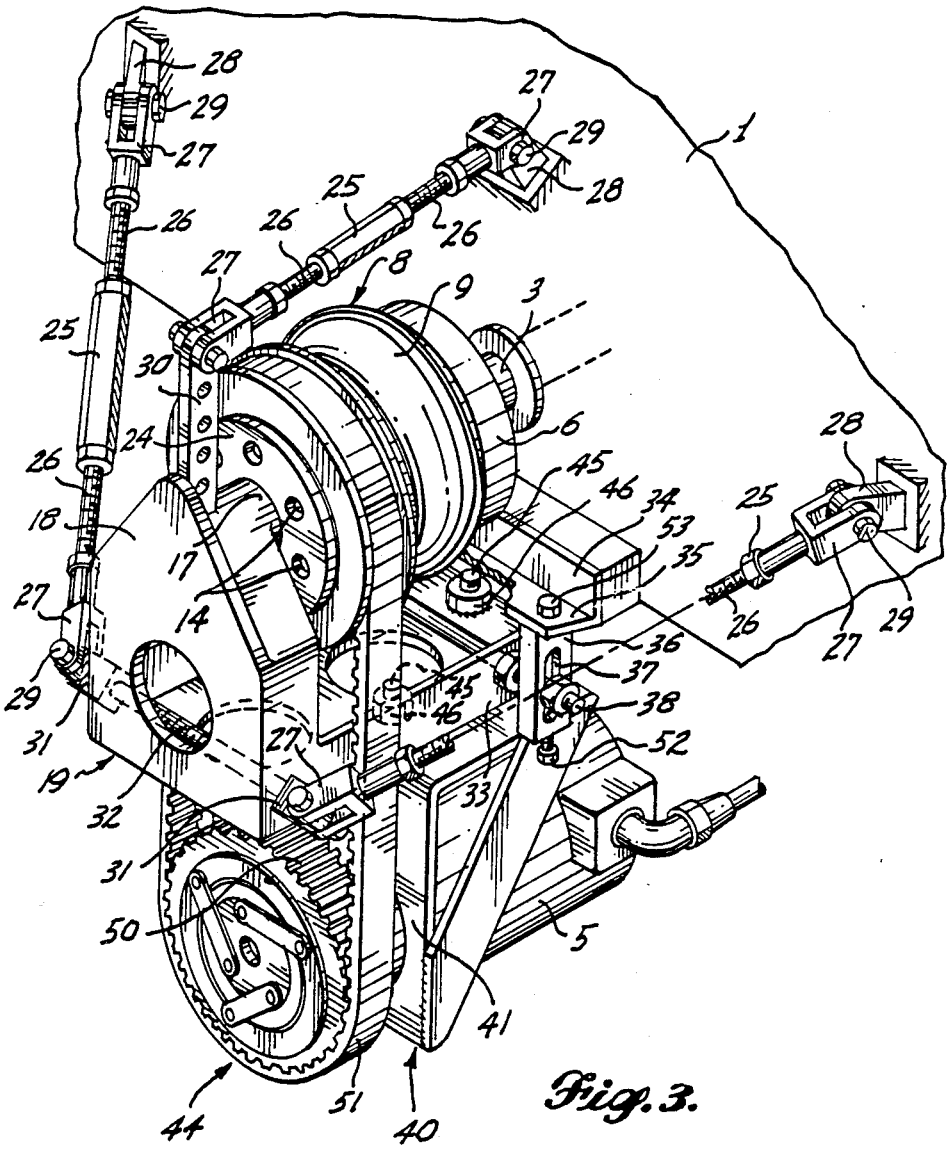
FIG. 3 is a top perspective of the power take-off of FIGS. 1 and 2.
Figure 4:
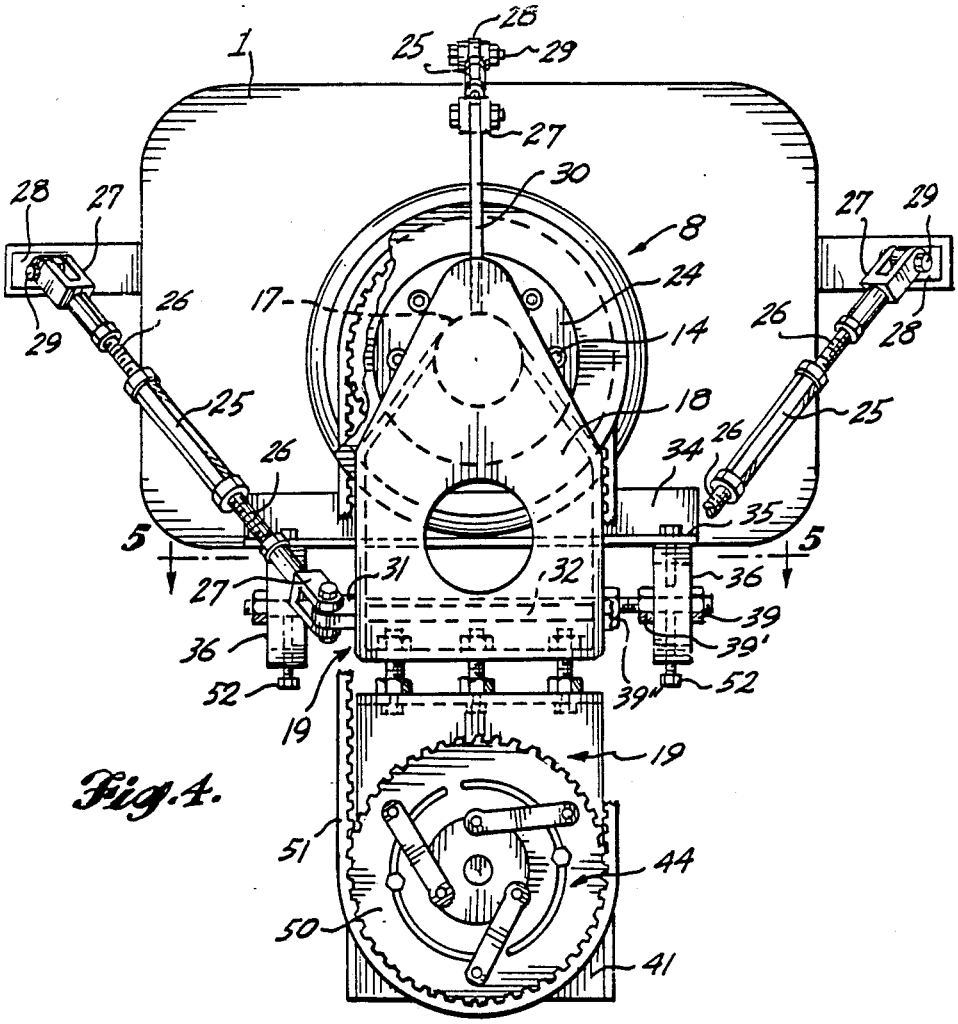
FIG. 4 is a front elevation thereof.

Stub shaft 17 projects rearward from the upright leg 18 of an angle support frame 19. The mounting of such frame 19 to the engine 1 is best seen in FIGS. 3 and 4. Three connection points are located on the front end portion of the engine, at the top and at its opposite sides, for stays in the form of turnbuckles 25 of the type having right-and-left threaded spindles or screws 26 and clevises 27 at their opposite ends. In the illustrated embodiment, the front end portion of the engine 1 is modified to have apertured mounting lugs 28 for connection of the rear ends of the clevises by bolts 29. The top turnbuckle extends forward to a bracket 30 projecting upward from the stub shaft 17. The turnbuckles at the sides extend forward and downward to ears 31 projecting oppositely, respectively, from the bottom portion of the frame upright leg 18, a substantial distance below the stub shaft 17. Ears 31 preferably are carried at the opposite ends of a horizontal rod 32 so that they are turnable conjointly about the axis of the rod for convenient receipt of the turnbuckle clevises 27.

With reference to FIG. 3, frame 19 has a horizontal leg 33 projecting rearward from the bottom portion of the upright leg 18 almost to the front of the engine 1. In the illustrated embodiment, the engine is modified to have a stationary angle mounting bracket 34 including a forward-projecting flange 35 carrying downward-projecting mounting blocks 36 with upright slots 37. Blocks 36 are positioned at opposite sides of the horizontal frame leg 33. Their slots 37 receive the opposite end portions of a crosstie 38 extending through the opposite sides of leg 33. With reference to FIG. 4, the crosstie is clamped stationarily relative to the engine by outer and inner nuts 39 and 39′ at opposite sides of each mounting block 36. The crosstie is positioned stationarily relative to the frame 19 by nuts 39″ clamping the opposite sides of the frame horizontal leg 33.

Figure 5:
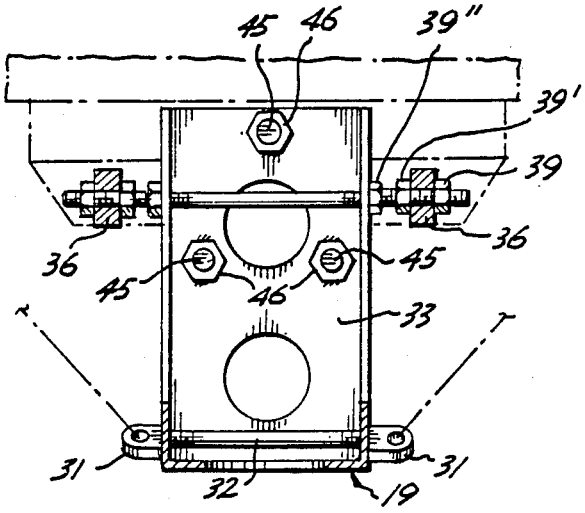
FIG. 5 is a fragmentary section along line 5—5 of FIG. 4.

With reference to FIGS. 2 and 3, the pump 5 is secured to a smaller angle bracket 40 which has an upright leg 41 clamped between the pump mounting flange 42 and the housing 43 of a conventional electric clutch 44 such as the model H28D200 clutch available from Pitts Industries, Inc., of Dallas, Tex. Bracket 40 is hung from the horizontal leg 33 of the larger support frame 19 by three bolts 45 extending through the top horizontal leg of the bracket and arranged in a triangle as best seen in FIG. 5. Bolts 45 have enlarged heads 47 and extend upward through nuts 46 fixed to the horizontal leg 33 of the frame. Mounting bolts 48 extend through the horizontal flange 49 of the pump bracket 40 and are threaded into blind bores in the bolts 45. With the mounting bolts 48 loosened, turning the adjustment bolts 45 shifts the bracket 40 and the pump 50 up or down.

The electric clutch 44 has a drive sheave 50, preferably a cogwheel, which is operatively connected to the sheave 12 by a belt 51, preferably a cog belt.

The preferred procedure for installation of the power take-off in accordance with the present invention is as follows:

Convenient attachment points for the turnbuckles 25 and stationary mounting blocks 36 are located on the front end portion of the marine engine and any required modifications are made, such as securing the lugs 28 and the bottom angle support bracket 34. The support frame 19 is preliminarily and loosely installed by means of the bottom crosstie 38 and only the top turnbuckle 25.

Preliminary vertical adjustment of the frame is achieved by turning adjustment bolts 52 which are threaded through the bottoms of the mounting blocks 36 for engaging and lifting the crosstie 38. When the rear end of the stub shaft 17 is substantially aligned with the front end of the crankshaft portion 3, the top turnbuckle 25 can be tightened or loosened for placing the axis of the stub shaft in approximately the same horizontal plane as the axis of the crankshaft. Lateral alignment of the stub shaft with the crankshaft is obtained by tightening the nuts 39″ which fix the crosstie 38 relative to the frame 19 and using the outer nuts 39 to shift the frame sideways as required, whereupon the inner nuts 39′ are tightened to fix the crosstie 38 relative to the mounting blocks 36. Preferably such blocks are secured to the flange 35 of angle bracket 34 by bolts 52 which are received in fore-and-aft elongated slots of flange 35. Consequently, with bolts 52 loosened, the frame can be twisted to place the stub shaft 17 with its axis in the same vertical plane as the axis of the crankshaft 3. Then bolts 52 are tightened to fix the mounting blocks 36 relative to the angle bracket 34 and engine 1.

Next, the side turnbuckles are installed and, after the alignment is checked, the clevises 27 are rigidly secured to the respective lugs, ears and bracket by tightening the bolts 29 and all locknuts threaded on the spindle or screw 26.

With the frame 19 rigidly in position, the pump 5 can be hung from the frame horizontal leg 33 by means of the adjusting bolts 45 and mounting bolts 48 extending through the pump bracket 40. The cog belt 51 and flex coupling 8 are installed and the belt can be tightened by turning the mounting bolts 45 to shift the pump bracket and the pump down. Finally, with the engine running the angular orientation of the clutch cogwheel 50 with respect to the top cogwheel 12 is adjusted to assure that the cog belt rides in the center of both cogwheels by turning the single rear adjustment bolt 45 so as to pivot the pump bracket, whereupon the mounting bolts 48 are tightened and installation is complete.

Since the pump 5 is hung directly from the engine, the power take-off is not effected by vibration, or twisting or fore-and-aft surging of the engine. In addition, the substantial tension of the cog belt 49 required to power the high capacity pump 5 results in radial force being applied only to the stub shaft 17. The flex coupling 8 isolates the engine crankshaft 3 from any side thrust or even end float.

I claim:

1. A power take-off for transmitting rotary force from the front nondriving end portion of the crankshaft of a marine engine to the rotary input member of a hydraulic pump comprising a frame having an upright leg and a rearward-projecting stub shaft cantilevered from said upright leg, means for stationarily mounting said frame on the engine with said stub shaft spaced forward from and coaxial with the engine crankshaft front end portion, an intermediate sheave rotatably mounted on the stub shaft, flex coupling means coupling said intermediate sheave to the engine crankshaft including a flexible force-transmitting member connected between the crankshaft and said intermediate sheave, a pump input sheave for driving the pump rotary input member, means mounting the pump with its input sheave substantially in alignment radially with said intermediate sheave, and a belt coupling said two sheaves such that radial force applied to said intermediate sheave by said belt is transmitted to said frame stub shaft without being transmitted to the engine crankshaft, said frame including a horizontal leg projecting rearward from the bottom end portion of said upright leg a substantial distance below said stub shaft, said frame mounting means including a crosstie extending through and projecting oppositely from said frame horizontal leg and means for supporting said crosstie from the engine.

2. The power take-off defined in claim 1, including means for shifting the crosstie elevationally relative to the engine for vertical translation of the frame.

3. The power take-off defined in claim 1, including means for shifting the frame horizontal leg in a direction longitudinally of the crosstie for horizontal translation of the frame transversely of the engine.

* * * * *